US009356387B1

(12) United States Patent
Taylor et al.

(10) Patent No.: US 9,356,387 B1
(45) Date of Patent: May 31, 2016

(54) SEALED ELECTRICAL CONNECTOR ASSEMBLY

(71) Applicant: Glenair, Inc., Glendale, CA (US)

(72) Inventors: Zachary W. Taylor, Paso Robles, CA (US); Chris H. McDonald, Yorba Linda, CA (US); Aaron N. Keep, Paso Robles, CA (US); Mehrdad Ghara, Aliso Viejo, CA (US)

(73) Assignee: GLENAIR, INC., Glendale, CA (US)

( * ) Notice: Subject to any disclaimer, the term of this patent is extended or adjusted under 35 U.S.C. 154(b) by 0 days.

(21) Appl. No.: 14/685,580

(22) Filed: Apr. 13, 2015

(51) Int. Cl.
*H01R 13/40* (2006.01)
*H01R 13/52* (2006.01)
*H01R 9/18* (2006.01)

(52) U.S. Cl.
CPC ..... *H01R 13/5205* (2013.01); *H01R 9/18* (2013.01)

(58) Field of Classification Search
USPC ..... 439/587, 583, 584, 589
See application file for complete search history.

(56) References Cited

U.S. PATENT DOCUMENTS 5,458,507 A * 10/1995 Colescott ..... H01R 13/5205 439/589
7,408,122 B2 * 8/2008 Heimlicher ..... H02G 3/0658 16/2.1
8,113,878 B2 * 2/2012 Clausen ..... H01R 24/564 439/584
8,919,221 B2 * 12/2014 Chiou ..... F16C 1/102 174/520

* cited by examiner

*Primary Examiner* — Tho D Ta
(74) *Attorney, Agent, or Firm* — David S. Alavi

(57) ABSTRACT

A connector assembly comprises front and rear connector bodies, a wire grommet with wire passages, and a nut. Tightening the nut forces a rearward portion of the grommet into a tapered segment of a passage through the rear connector body, thereby radially compressing the grommet and sealing the wires passing therethrough.

27 Claims, 15 Drawing Sheets

SEALED ELECTRICAL CONNECTOR ASSEMBLY

FIELD OF THE INVENTION

The field of the present invention relates to electrical connector assemblies. In particular, a sealed electrical connector assembly including a radially compressed wire grommet is disclosed herein.

BACKGROUND

In certain circumstances it is desirable to isolate from a use environment the electrical contacts and wires within an electrical connector assembly. One such circumstance arises when electrical connectors are employed in aviation. Exposure to extremes of temperature, pressure, or humidity, and frequent cycling between those extremes (e.g., with each takeoff, climb, cruise, descent, and landing) can lead to corrosion or other degradation of the electrically conductive parts of the connector. In certain conventional electrical connector assemblies a resiliently deformable wire grommet is employed to seal around one or more wires that enter the connector assembly. It may be desirable to provide improved or enhanced sealing around the wires by a wire grommet.

SUMMARY

An inventive connector assembly comprises a substantially rigid front connector body, a substantially rigid rear connector body, a resiliently deformable wire grommet, and a threaded nut. The resiliently deformable wire grommet has a substantially cylindrical outer surface and one or more axial wire passages therethrough. Each wire passage includes two or more wire-sealing segments; each wire-sealing segment is sized and shaped so as to (i) enable a corresponding wire to be inserted through the corresponding wire passage and (ii) form a seal around the corresponding inserted wire. The rear connector body has a rear axial passage therethrough. A front end of the rear axial passage is large enough to receive therein a rearward portion of the grommet without substantial radial compression of the grommet. A rearward-tapered segment of the rear axial passage is structurally arranged so as to receive therein the rearward portion of the grommet, engage the outer surface of the rearward portion of the grommet, and compress radially the rearward portion of the grommet and two or more of the wire-sealing segments of each wire passage therein.

The front connector body has a front axial passage. A rearward portion of the front connector body includes external threads. A forward portion of the front connector body is structurally arranged so as to hold one or more electrical contacts that are each connected to a corresponding wire passing through the rear axial passage and the corresponding wire passage of the grommet. At least portions, including a rearward portion, of the front axial passage are structurally arranged so as to receive therein the grommet without substantial radial compression of the grommet. The nut has a central opening and internal threads. The nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body. The connector assembly is structurally arranged so that tightening of the nut threadedly engaged on the rearward portion of the front connector body results in forward movement of the nut and the rear connector body toward the front connector body, rearward movement of the rearward portion of the grommet into the tapered segment of the rear axial passage, and radial compression, by the tapered segment of the rear axial passage, of the rearward portion of the grommet and two or more of the wire-sealing segments of each wire passage therein.

A method employing the inventive connector assembly comprises: (a) inserting each one of a set of one or more wires through the wire grommet through a corresponding one of the one or more wire passages; (b) securing one or more corresponding electrical contacts, connected to the forward ends of the wires, to be held by the forward portion of the front connector body; (c) inserting the grommet into the front axial passage; (d) engaging the front and rear connector bodies; (e) threadedly engaging the nut and the front connector body; and (f) tightening of the nut threadedly engaged on the rearward portion of the front connector body, thereby resulting in forward movement of the nut and the rear connector body toward the front connector body, rearward movement of the rearward portion of the grommet into the tapered segment of the rear axial passage, and radial compression, by the tapered segment of the rear axial passage, of the rearward portion of the grommet and two or more of the wire-sealing segments of each wire passage therein.

Objects and advantages pertaining to sealed electrical connector assemblies may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The embodiments depicted are shown only schematically: all features may not be shown in full detail or in proper proportion, certain features or structures may be exaggerated relative to others for clarity, and the drawings should not be regarded as being to scale. In FIGS. 3-7 and 12-16, cross hatching has been omitted to reduce clutter in the drawings. The embodiments shown are only examples: they should not be construed as limiting the scope of the present disclosure or appended claims.

DETAILED DESCRIPTION OF EMBODIMENTS

Figure 1:
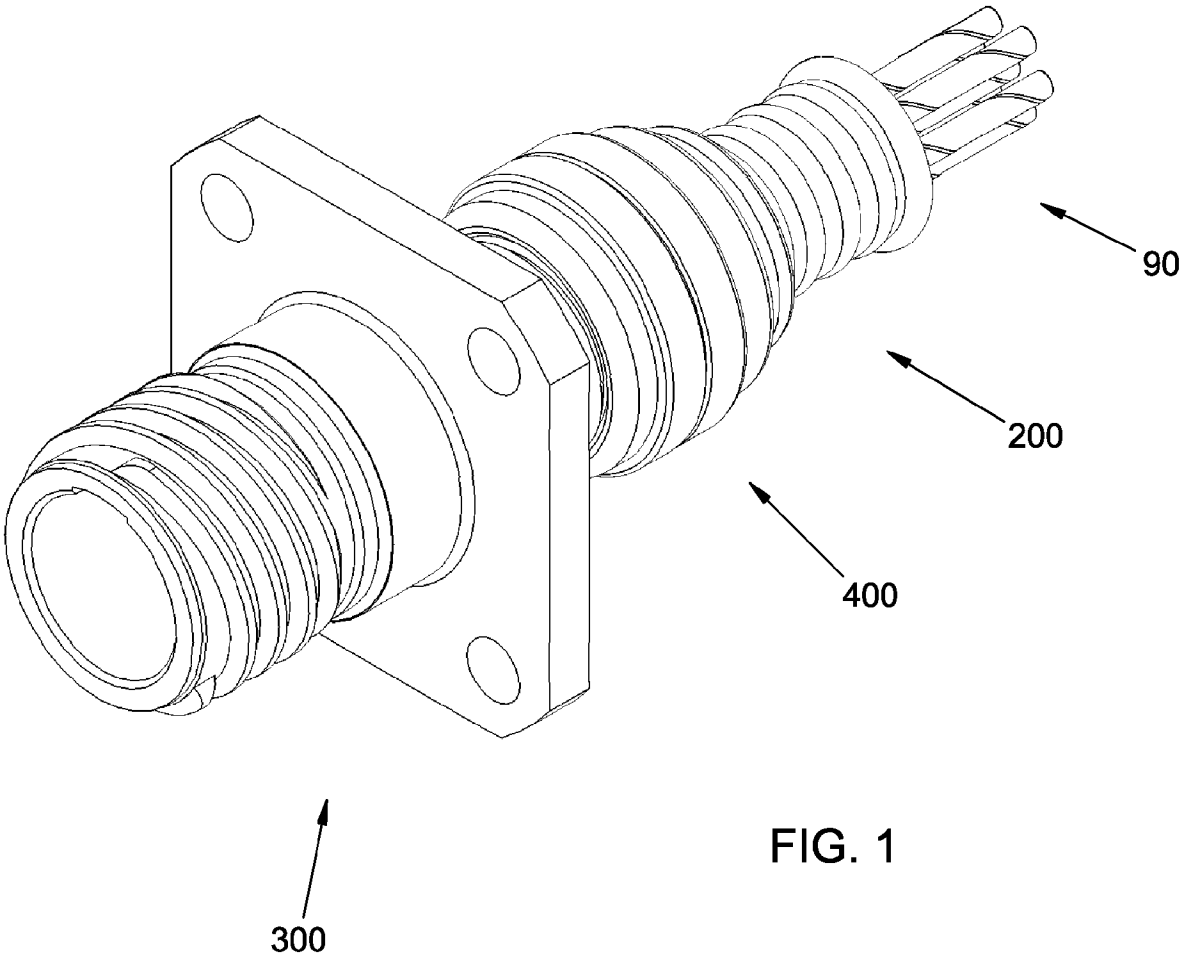
FIG. 1 is an isometric view of an example of an inventive sealed electrical connector assembly with wires in a fully assembled arrangement.
Figure 2:
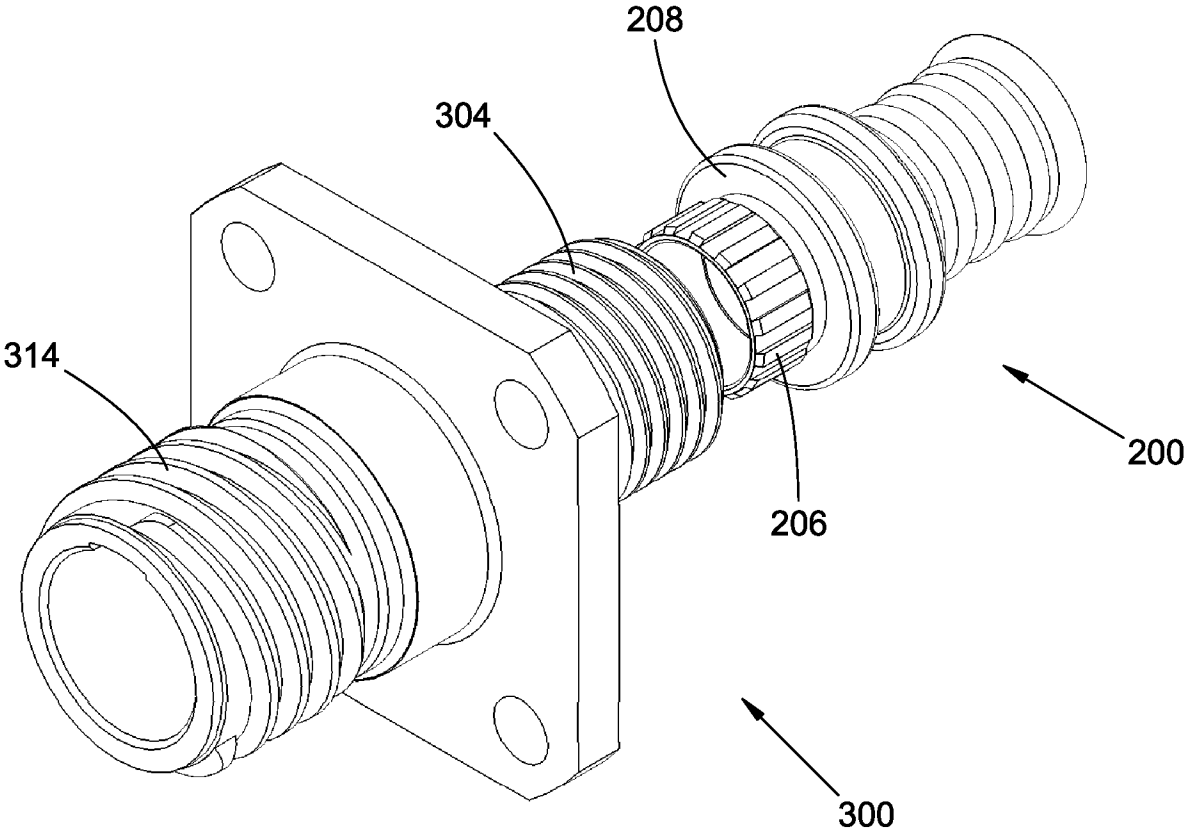
FIG. 2 is an isometric view of front and rear connector bodies of the example inventive connector assembly.
Figure 3:
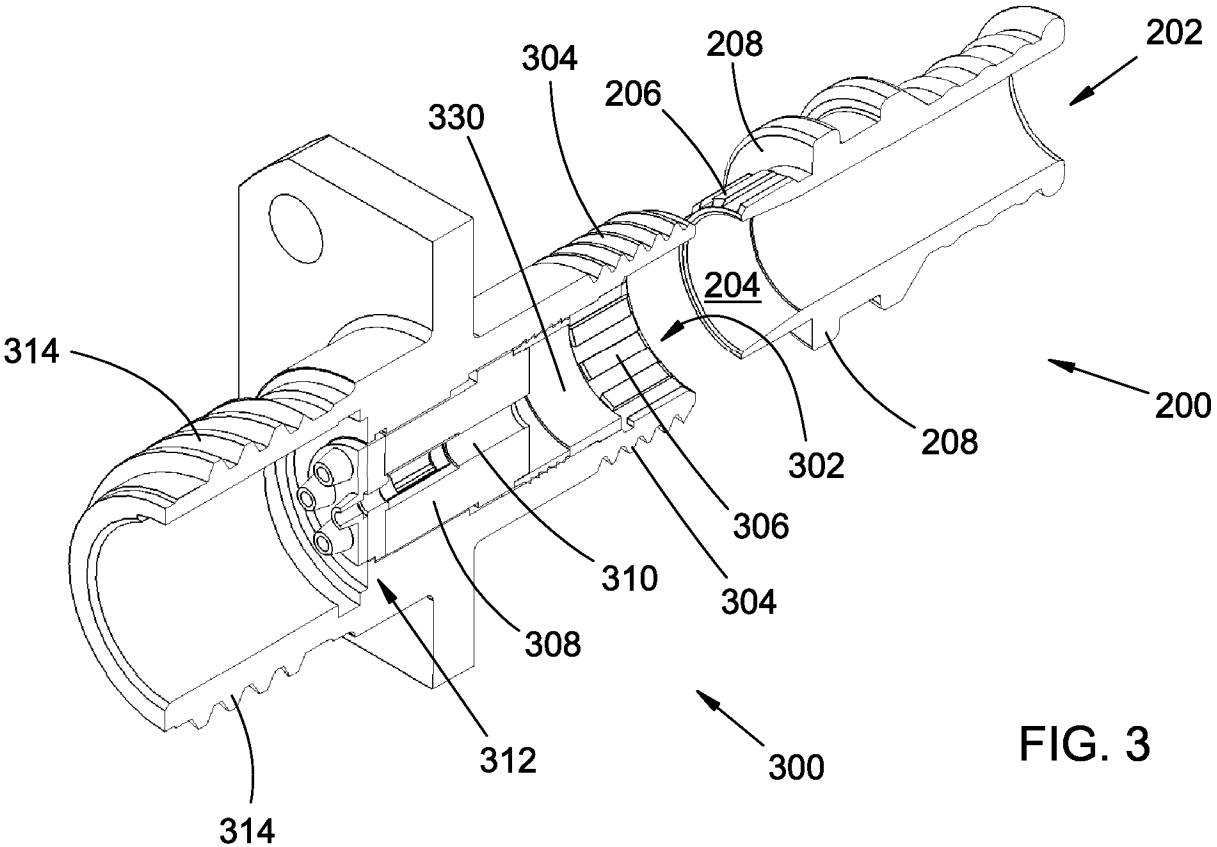
FIG. 3 is an isometric view of a longitudinal cross section of the front and rear connector bodies of the example inventive connector assembly.
Figure 4:
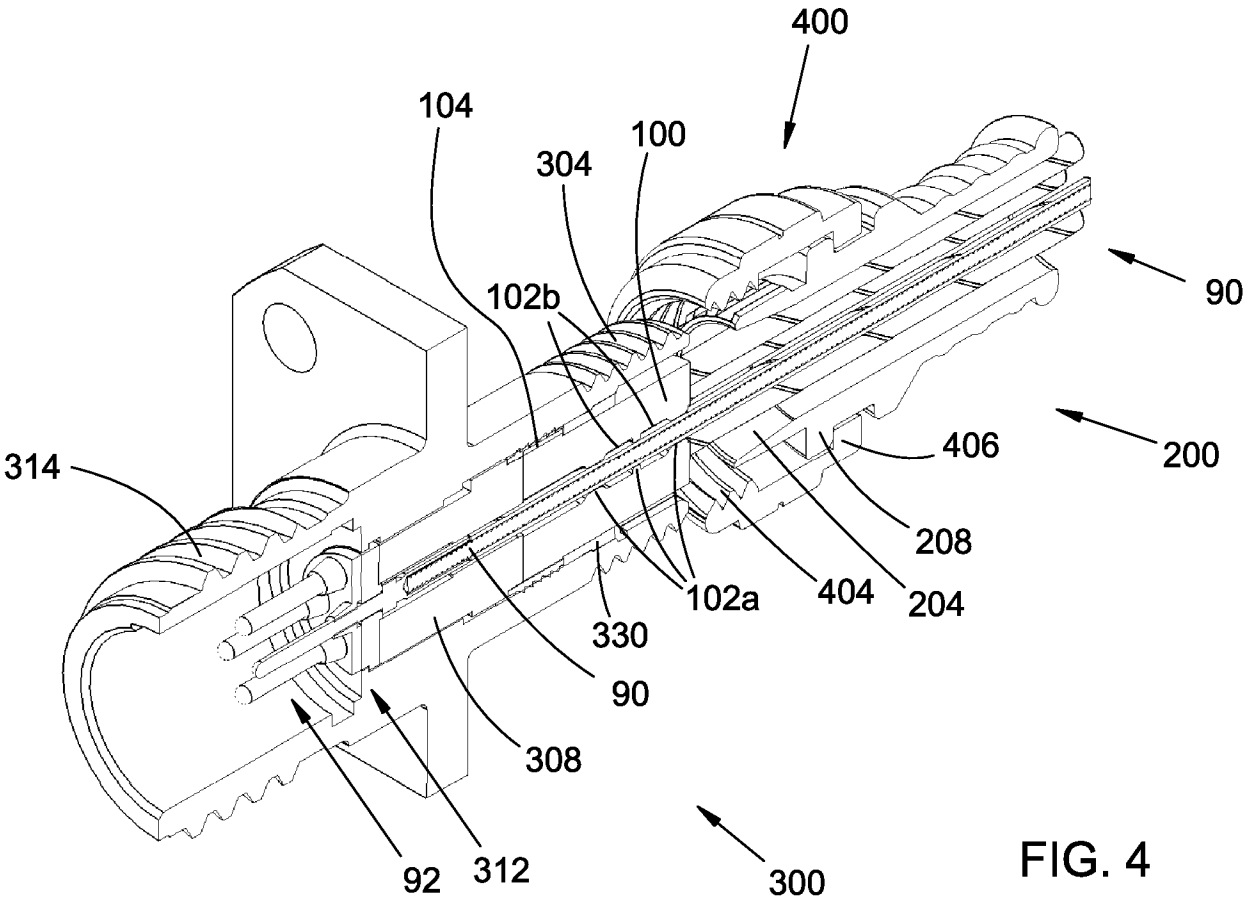
FIGS. 4 and 5 are isometric and side views, respectively, of a longitudinal cross section of the example inventive connector assembly with wires and contacts in a partly assembled arrangement.
Figure 5:
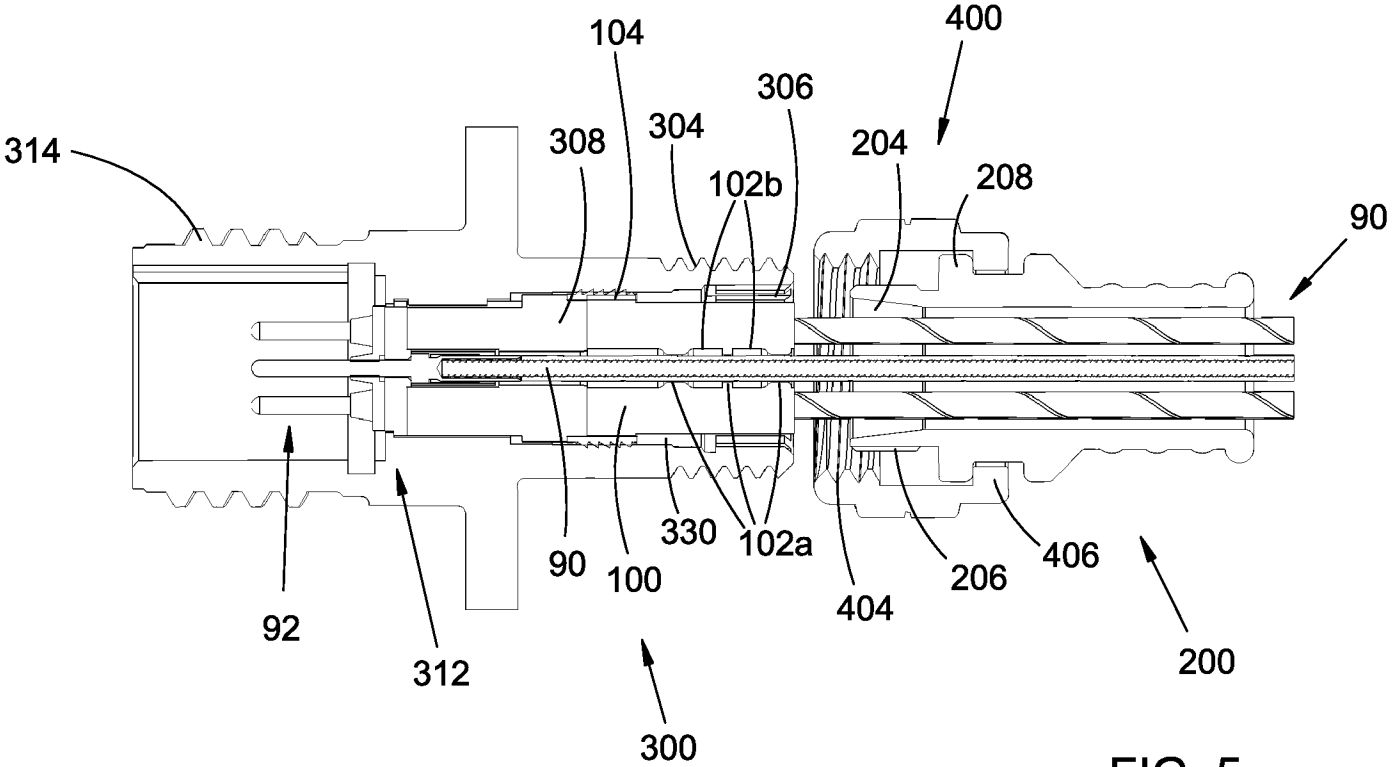
Figure 6:
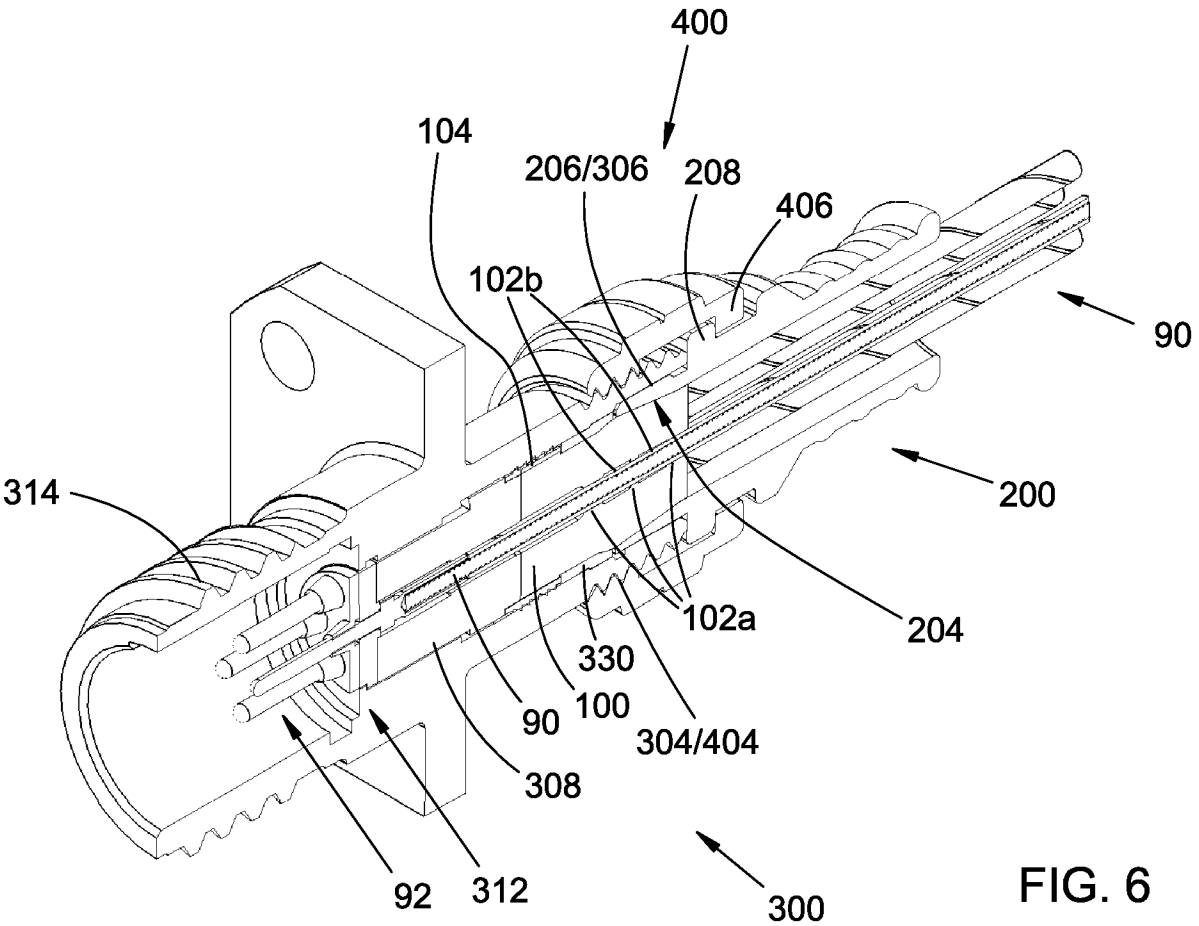
FIGS. 6 and 7 are isometric and side views, respectively, of a longitudinal cross section of the example inventive connector assembly with wires and contacts in a fully assembled arrangement.
Figure 7:
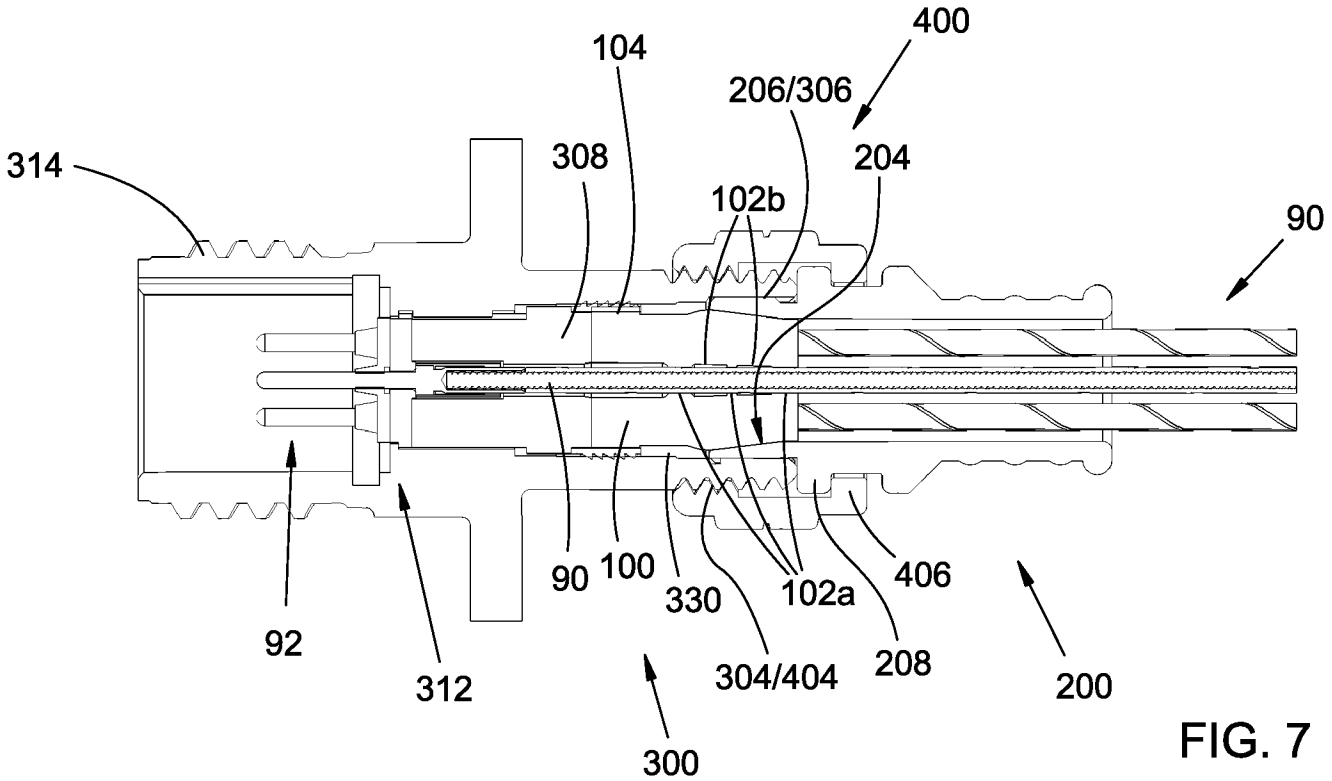
Figure 8:
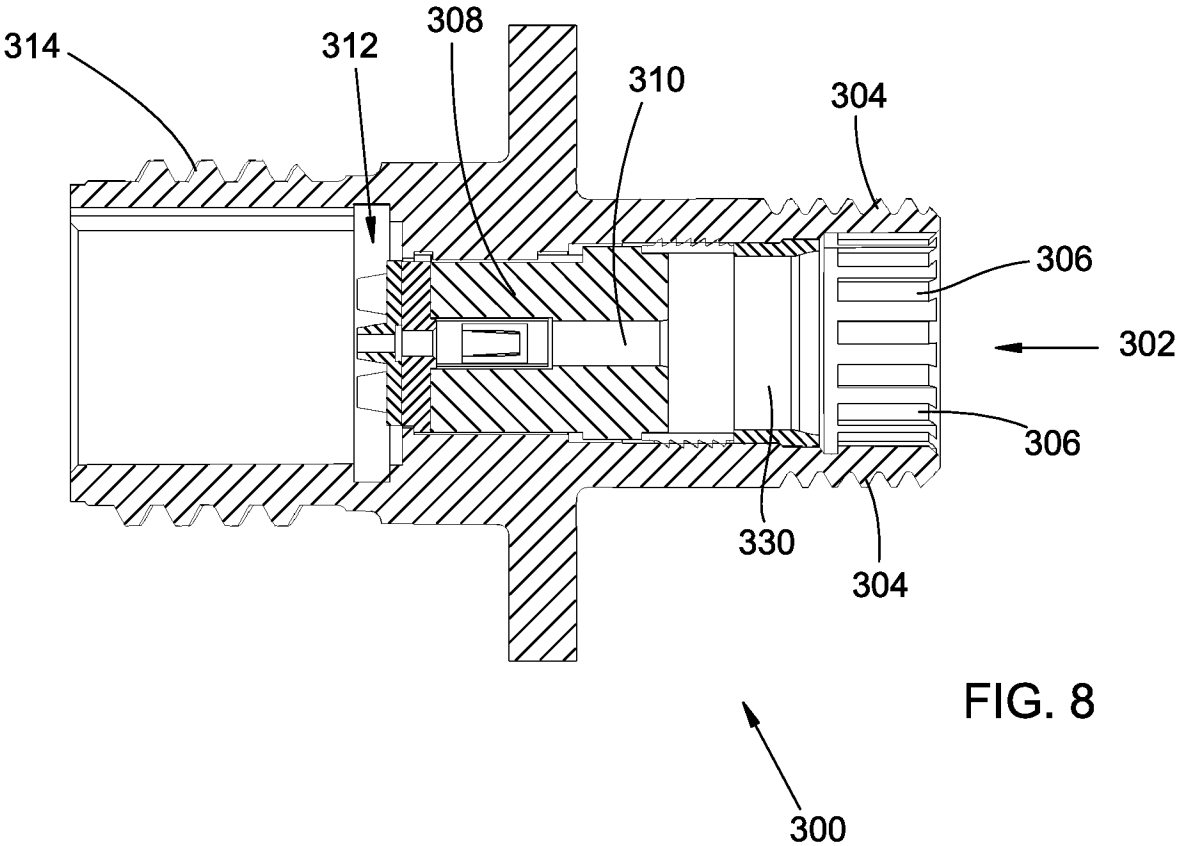
FIGS. 8-11 are side views of longitudinal cross sections of a front connector body, rear connector body, wire grommet, and nut, respectively, of the example inventive connector assembly.
Figure 9:
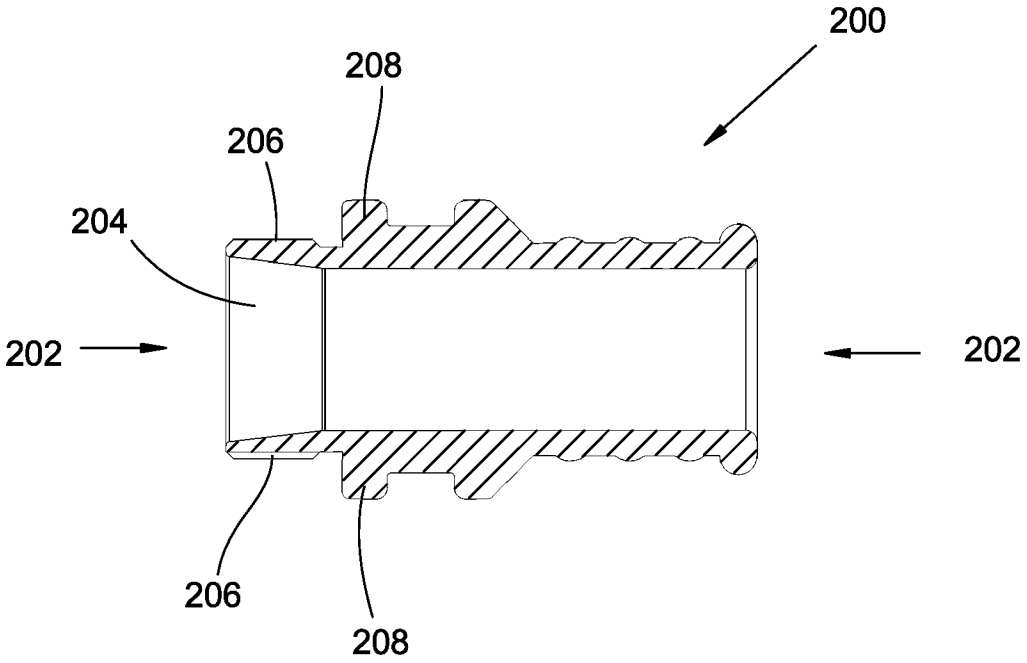
Figures 10, 11:
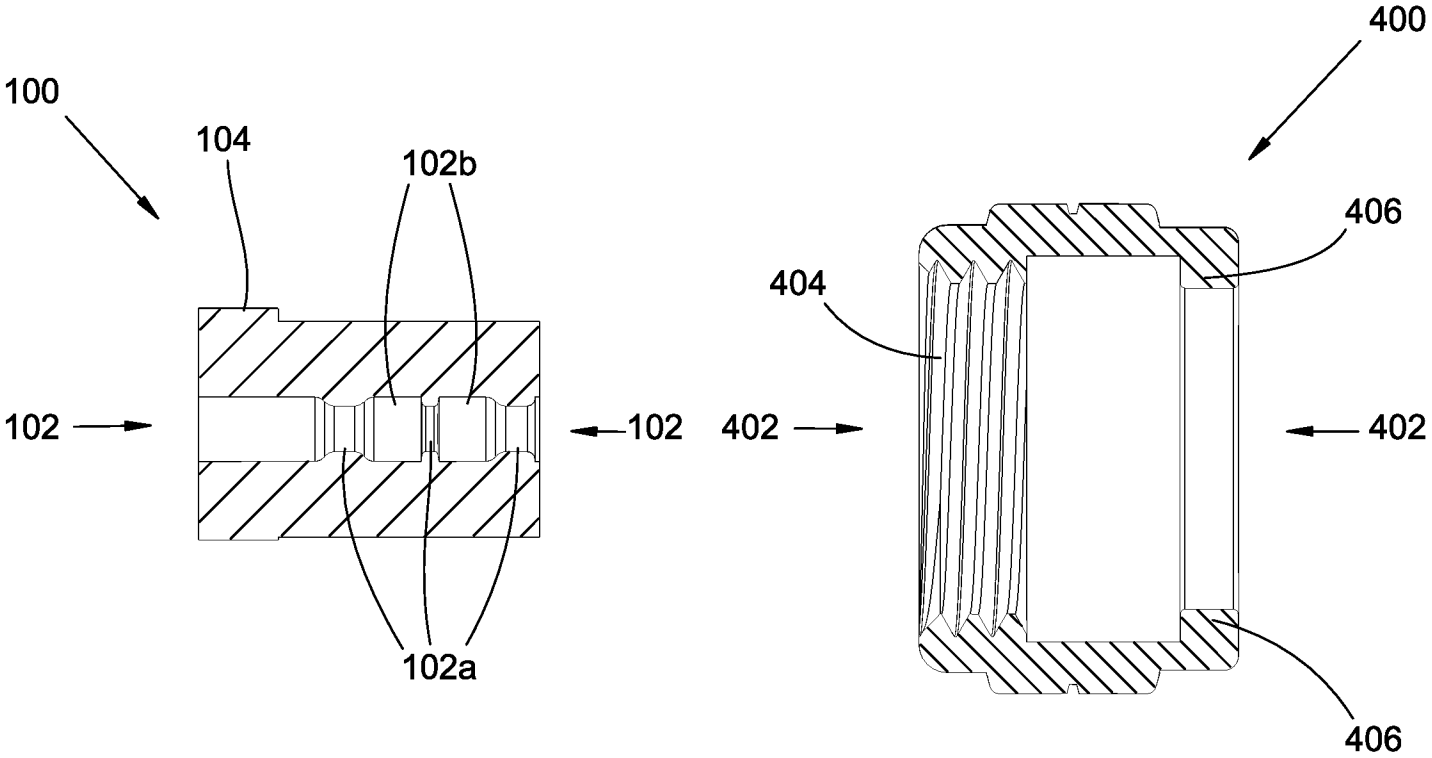

A connector assembly (FIGS. 1-7) comprises a substantially rigid front connector body 300 (FIG. 8); a substantially rigid rear connector body 200 (FIG. 9); a resiliently deformable wire grommet 100 (FIG. 10); and a threaded nut 400 (FIG. 11). The front connector body 300, the rear connector body 200, and the nut 400 can each comprise any one or more suitably rigid solid materials, including but not limited to: one or more metals or metal alloys; one or more plastics, resins, or polymers; one or more natural or synthetic fibrous materials; one or more other electrically conductive materials; or one or more other electrical insulating materials.

For purposes of the present disclosure and appended claims, directional terms such a front, forward, rear, rearward, and so forth are defined relative to the connector assembly, with "front" and the like being the direction from the connector assembly toward a mating connector assembly, and "rear" and the like being the opposite direction, i.e., toward one or more wires or a cable connected to the connector assembly. Any motion or movement recited in the disclosure, examples, or claims are relative motions or movements, e.g., forward movement of the rear connector body 200 toward the front connector body 300 is equivalent to rearward movement of the front connector body 300 toward the rear connector body 200.

The substantially rigid rear connector body 200 (also referred to as a connector accessory or as a connector backshell) has a rear axial passage 202 therethrough; the substantially rigid front connector body 300 (also referred to as a plug connector body in a plug-type connector assembly, or as a receptacle connector body in a receptacle-type connector assembly) has a front axial passage 302. When the connector assembly is connected to one or more wires 90 (seven wires 90 in the examples shown; any suitable number of one or more wires can be employed) and assembled, a resiliently deformable wire grommet 100 is positioned within the front axial passage 302 and the wires 90 pass through the rear axial passage 202 and through corresponding wire passages 102 of the grommet 100. A forward portion of the front connector body 300 is structurally arranged so as to hold one or more electrical contacts 92 that are each connected to a corresponding wire 90. In the examples shown the electrical contacts 92 are pin contacts of a bulkhead-mounted receptacle-type connector; in other examples the contacts are socket contacts. Any suitable number (one through 128 or more), type (e.g., pin or socket), or arrangement (e.g., square, rectangular, polygonal, or circular array or arrangement) of the one or more electrical contacts 92 can be employed in any type of connector assembly (e.g., plug, receptacle, bulkhead-mounted, wall-mounted, or cable-mounted). The wire grommet 100 serves to isolate the electrical contacts 92 and the conductive cores of the wires 90 from a use environment.

Any suitably rigid material can be employed for the front connector body 300 and the rear connector body 200, as noted above. In many example embodiments, the rear connector body 200 comprises a metal or metal alloy, so that the rear connector body 200 is electrically conducting and can serve to at least partly electromagnetically shield the one or more wires 90 passing through the rear axial passage 202. If the wires 90 are contained within a sheath (not shown) rearward of the connector assembly, that sheath can continue around a rearward portion of the rear connector body, if needed or desired. In some examples such a sheath can include conductive sheathing that serves as electromagnetic shielding for the wires 90, and electrical continuity can be established between such conductive sheathing and a conductive rear connector body 200 (e.g., by banding or crimping the conductive sheath onto the rear connector body 200). In some examples the sheath can include an outer insulating layer that continues around a rearward portion of the rear connector body 200 (e.g., plastic or elastomeric shrink tubing applied around the wires 90 and the rear connector body 200).

In many example embodiments, the front connector body 300 includes one or more metals or metal alloys, which can serve as electrical shielding in a manner similar to that described for the rear connector body 200, particularly if both front and rear connector bodies 300 and 200 include one or more metals or metal alloys and are in electrical contact with one another. The front connector body typically also includes one or more insulating materials arranged for holding the electrical contacts 92 in place without introducing unwanted electrical contact between them (i.e., without shorting them). In the example embodiment shown, the front connector body 300 includes an insulating body 308 (comprising, e.g., thermoplastic or other suitable insulating material) with wire channels 310 therethrough. Each wire channel 310 accommodates a corresponding one of the wires 90 and has a corresponding one of the electrical contacts 92 held at its front end. Additional structural members 312 can be employed to hold the electrical contacts 92 in place if needed or desired. A front end of the front connector body 300 can be structurally adapted in any suitable way to engage a mating connector assembly. In the example embodiment shown, the front connector body 300 includes threads 314 for engaging a threaded portion of a mating connector (not shown).

When the front and rear connector bodies 300 and 200 are assembled, a forward portion of the front connector body 200 is received in a rearward portion of the front axial passage 302. An outer surface of the forward portion of the rear connector body 200 and the inner surface of the rearward portion of the front axial passage 302 are structurally adapted so as to effect non-rotatable and longitudinally movable engagement of the front and rear connector bodies 300 and 200. In some examples, the outer surface of the forward portion of the rear connector body 200 can include a set of one or more longitudinal splines, keys, or grooves, the inner surface of the rearward portion of the front axial passage 302 can include a set of one or more longitudinal splines, keys, or grooves, and engagement of the splines, keys, or grooves of the front and rear connector bodies 300 and 200 effects the non-rotatable and longitudinally movable engagement. In the example embodiment shown, the outer surface of the forward portion of the rear connector body 200 includes a set of multiple radially outward-extending longitudinal splines 206, the inner surface of the rearward portion of the front axial passage 302 includes a set of multiple radially inward-extending longitudinal splines 306, and engagement of the splines 306 and 206 of the front and rear connector bodies 300 and 200, respectively, effects the non-rotatable and longitudinally movable engagement. Longitudinal movement enables fully engaged assembly of the connector bodies 300 and 200 (discussed further below); non-rotatable engagement prevents twisting of the wire grommet 100 or wires 90 by relative rotation of the connector bodies 300 and 200 (e.g., induced by tightening the threaded nut 400; discussed further below).

The nut 400 includes a central opening 402 and internal threads 404. The nut 400 is structurally arranged so as to receive through the central opening 402 a rearward portion of the rear connector body 200 and to obstruct rearward movement of the forward portion of the rear connector body 200 through the central opening 402. In the example embodiment shown, an outward circumferential flange 208 of the rear connector body 200 is too large to pass an inward circumferential flange 406 of the nut 400; other suitable structural arrangements can be employed. A rearward portion of the front connector body 300 includes external threads 304 that engage the internal threads 404 of the nut 400. Tightening of the nut 400 threadedly engaged on the rearward portion of the front connector body 300 (via threads 304/404) results in forward movement of the nut 400 and the rear connector body 200 toward the front connector body 300 and concomitant forward movement of the non-rotatably engaged forward portion of the rear connector body 200 into the rearward portion of the front axial passage 302. Fully tightening the nut 400 results in fully engaged assembly of the connector bodies 300 and 200 at the forward limit of forward movement of the rear connector body 200 and the nut 400. In some examples, contact between the flange 208 of the rear connector body 200 and a rear end of the front connector body 300 limits the forward movement. In some examples, the connector assembly is structurally arranged so as to enable the non-rotatable and longitudinally movable engagement of the front and rear connector bodies 300 and 200 without threaded engagement of the nut 400 and the front connector body 300; once the connector bodies 300 and 200 are engaged, the rear connector body 200 can be moved forward until the threads 404 of the nut 400 can engage the threads 304 of the front connector body 300.

The resiliently deformable (i.e., elastically deformable) wire grommet 100 has a substantially cylindrical outer surface and one or more axial wire passages 102 therethrough. Each wire passage 102 includes two or more wire-sealing segments 102*a* (also referred to as glands). Each wire passage 102 typically also includes an intervening, transversely enlarged, internal chamber 102*b* between each adjacent pair of wire-sealing segments 102*a* along each wire passage 102; such enlarged chambers 102*b* can facilitate insertion of the wires 90 through the corresponding passages 102 (e.g., by providing space to accommodate displacement of compressed grommet material from adjacent wire-sealing segments 102*a*) without unduly compromising the sealing of each wire 90 by the corresponding passage 102. Each wire-sealing segment 102*a* is sized and shaped so as to (i) enable a corresponding wire 90 to be inserted through the corresponding wire passage 102 and (ii) form a seal around the corresponding inserted wire 90. Typically this is achieved by making the wire-sealing segments 102*a* slightly smaller than the thickness of the wire 90. Resilient stretching of each wire-sealing segment 102*a* enables the slightly over-sized wire 90 (and in some examples a wire-containing tube of an insertion/removal tool) to be inserted through the passage 102; resilient rebound of each wire-sealing segment 102*a* creates a seal around the corresponding wire 90. Exactly how much smaller than the wire thickness are the wire-sealing segments can vary and typically is determined by the properties of the resilient grommet material, the surface characteristics of the wire insulation, the cross-sectional shapes of the wires 90 and the wire-sealing segments 102*a* (see below), the size of a wire-containing tube of an insertion/removal tool (if employed), the amount of radial compression of the wire grommet by the rear connector body (discussed further below), and the tightness of the seal needed or desired in a given use environment (i.e., to achieve operationally acceptable sealing). Any suitable size differential can be employed that enables insertion of the wires 90 through the wire passages 102 and also results in an operationally acceptable seal around the wires 90.

Typical resiliently deformable materials for wire grommet 100 include, but are not limited to: synthetic or natural rubber; silicone or fluorosilicone elastomer; fluorocarbon elastomer (e.g., Viton®); ethylene propylene diene monomer (EPDM) elastomer; neoprene; other resiliently deformable polymer or resin; or other suitable resiliently deformable material. In some example embodiments the grommet 100 or the front axial passage 302 can further include a rotational indexing structure (e.g., one or more mating longitudinal grooves, keys, or splines) arranged to permit insertion of the grommet 100 into the front axial passage 302 in only one relative orientation about a longitudinal axis; in the example shown the grommet 100 includes a key 104. In some examples, the grommet 100 can be attached or secured to the front connector body 300 within the front axial passage 302, e.g., by adhesive or a mechanical retaining member such as a snap ring or threaded retaining ring. In other examples, the grommet 100 is not secured or attached to the front connector body 300, but is held in place by the engagement of the front and rear connector bodies 300 and 200 with each other.

Any suitable cross-sectional shape can be employed for the wire-sealing segments 102*a*. In some example embodiments each wire-sealing segment 102*a* has a substantially circular cross section to accommodate a corresponding wire also having a circular cross section. A circular cross section for the wire-sealing segments 102*a* can be employed in some example embodiments with non-circular wires 90 (e.g., oval or elliptical cross sections), so as to eliminate the need to rotationally orient the non-circular wire 90 before inserting it into the corresponding wire passage 102. In still other example embodiments, non-circular wire-sealing segments 102*a* can be employed having a shape corresponding to a non-circular shape of the wires 90, with the wires 90 being properly oriented before insertion through the wire passages 102.

In some instances, resiliency of the grommet 100 and the size or shape differential between the wire-sealing segments 102*a* and the wires 90 may not result in a sufficiently good seal around the wires 90. Such instances can arise more frequently when non-circular wires 90 are employed with a grommet 100 having substantially circular wire-sealing segments 102*a* of the wire passages 102. Oval or elliptical wire cross sections arising from current wire manufacturing processes are increasingly common. Poor sealing can also arise with wires having insulation in the form of a spiral-wound tape, which results in a spiral ridge on the outer surface of the wire where each turn of the insulating tape overlaps an adjacent turn. That ridge can provide a path for moisture or other contaminants to enter the connector. It therefore would be desirable to provide enhanced sealing of the wires 90 by the grommet 100.

In the inventive connector assemblies disclosed herein, the front and rear connector bodies 300 and 200 are structurally adapted so as to provide, upon fully engaged assembly of the connector assembly, radial compression of the wire grommet 100 over a substantial fraction of its length, including radial compression of two or more of the wire-sealing segments 102*a*. That radial compression, particularly of two or more of the wire-sealing segments 102*a* of each wire passage 102, provides the desired enhanced sealing of the wires 90 by the grommet 100, even when non-circular wires 90 and circular wire-sealing segments 102*a* are employed, or even when wires 90 having spiral-wound insulation are employed.

To achieve the inventive arrangement, the front end of the rear axial passage 202 is large enough to receive therein a rearward portion of the grommet 100 without substantial radial compression of the grommet 100, and the rear axial passage 202 includes a rearward-tapered segment 204 (referred to hereafter as the tapered segment 204). The tapered segment 204 of the rear axial passage 202 is structurally arranged so as to receive therein the rearward portion of the grommet 100, engage its outer surface, and compress it radially along with radially compressing two or more of the wire-sealing segments 102*a* of each wire passage 102 within the grommet 100. At least portions, including a rearward portion, of the front axial passage 302 are structurally arranged so as to receive therein at least the forward portion of the grommet 100 without substantial radial compression of the grommet 100. In some examples (e.g., the embodiment of FIGS. 1-14), the rearward portion of the front axial passage 302 is structurally arranged to receive therein a forward portion of the rear connector body 200, including the tapered segment 204 of the rear axial passage 202, interposed between the rearward portion of the grommet 100 and an inner surface of the rearward portion of the front axial passage 302. The connector assembly is thus structurally arranged so that tightening the nut 400 drives the tapered segment 204 of the axial passage 202 forward into the rearward portion of the front axial passage 302 wedged between inner surface of the front axial passage 302 and the outer surface of the grommet 100. The wedge action of the tapered segment 204 on the outer surface of the grommet 100 results in radial compression of the rearward portion of the grommet 100 and two or more of the wire-sealing segments 102*a* of each wire passage 102 therein. In some examples, three or more wire-sealing segments can be radially compressed by the wedge action, on the outer surface of the grommet 100, of the tapered segment 204 of the rear axial passage 202. The non-rotatable engagement of the front and rear connector bodies 300 and 200 prevents torsional strain or twisting of the wire grommet 100 by the engaged tapered segment 204 as the rear connector body 200 is driven forward by tightening the nut 400. Such twisting or torsional strain can result in various undesirable effects, such as excessive resistance to tightening the nut 400, disruption of the sealing of the wire-sealing segments 102*a* around the wires 90, twisting or breakage of the wires 90, or structural failure of the wire grommet 100.

The grommet 100 comprises a resiliently deformable material to enable radial compression by the tapered segment 204 of the rear axial passage 202. However, such resilient materials are not necessarily particularly compressible; radial compression of the rearward portion of the grommet 100 typically causes a portion of the grommet 100 forward of the compressed portion to bulge outward, i.e., to expand radially. In some examples, a forward portion of the tapered segment 204 of the rear axial passage 202 can be structurally arranged so as to accommodate that radial expansion, e.g., by having a radius at its forward end that is larger than the radius of the grommet 100 in its uncompressed state. In some examples, at the forward limit of the forward movement of the rear connector body 200 toward the front connector body 300, a gap remains at a front end of the rear connector body 200 that can accommodate the radial expansion of that portion of the grommet 100 forward of the radially compressed rearward portion of the grommet 100. In some of those latter examples, a resilient sealant 330 can partly fill the gap.

Figure 12:
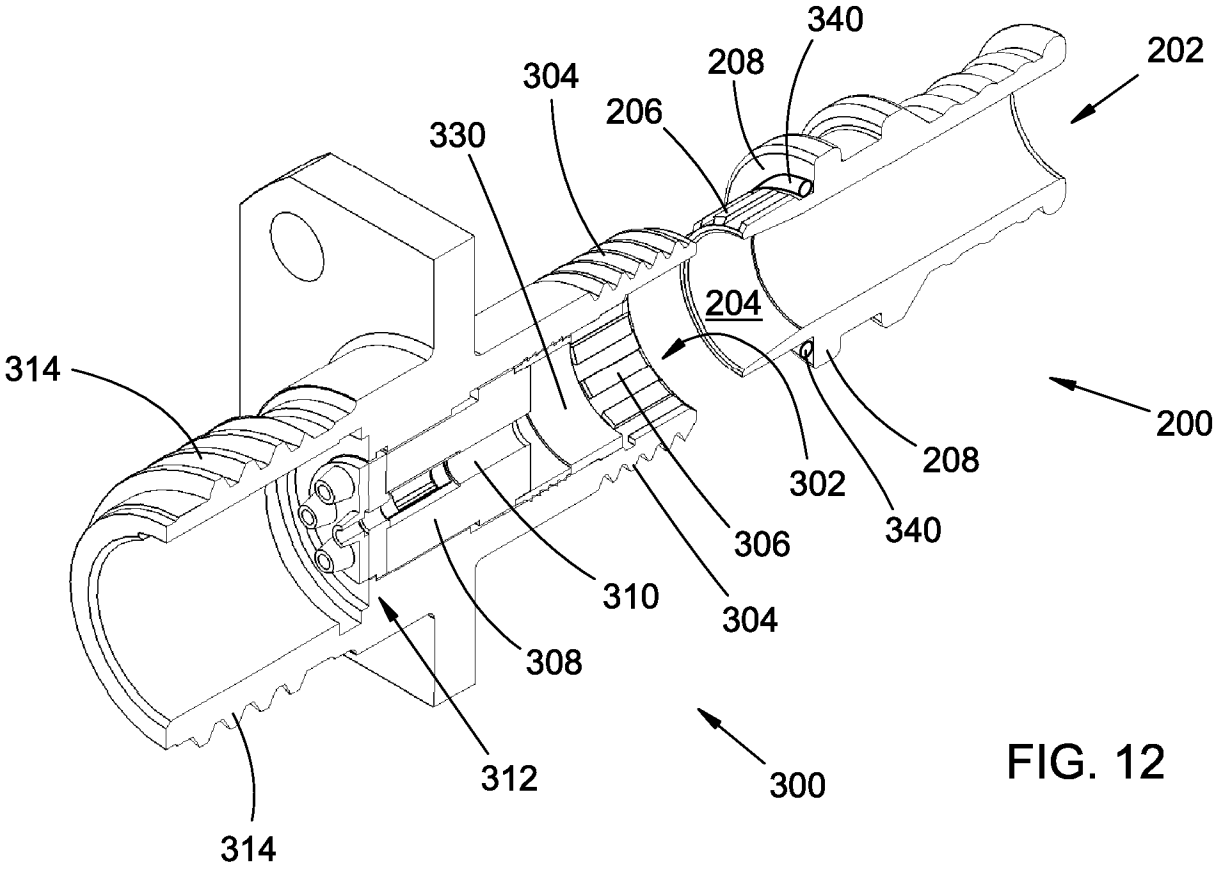
FIG. 12 is an isometric view of a longitudinal cross section of the front and rear connector bodies of the example inventive connector assembly with an O-ring.
Figure 13:
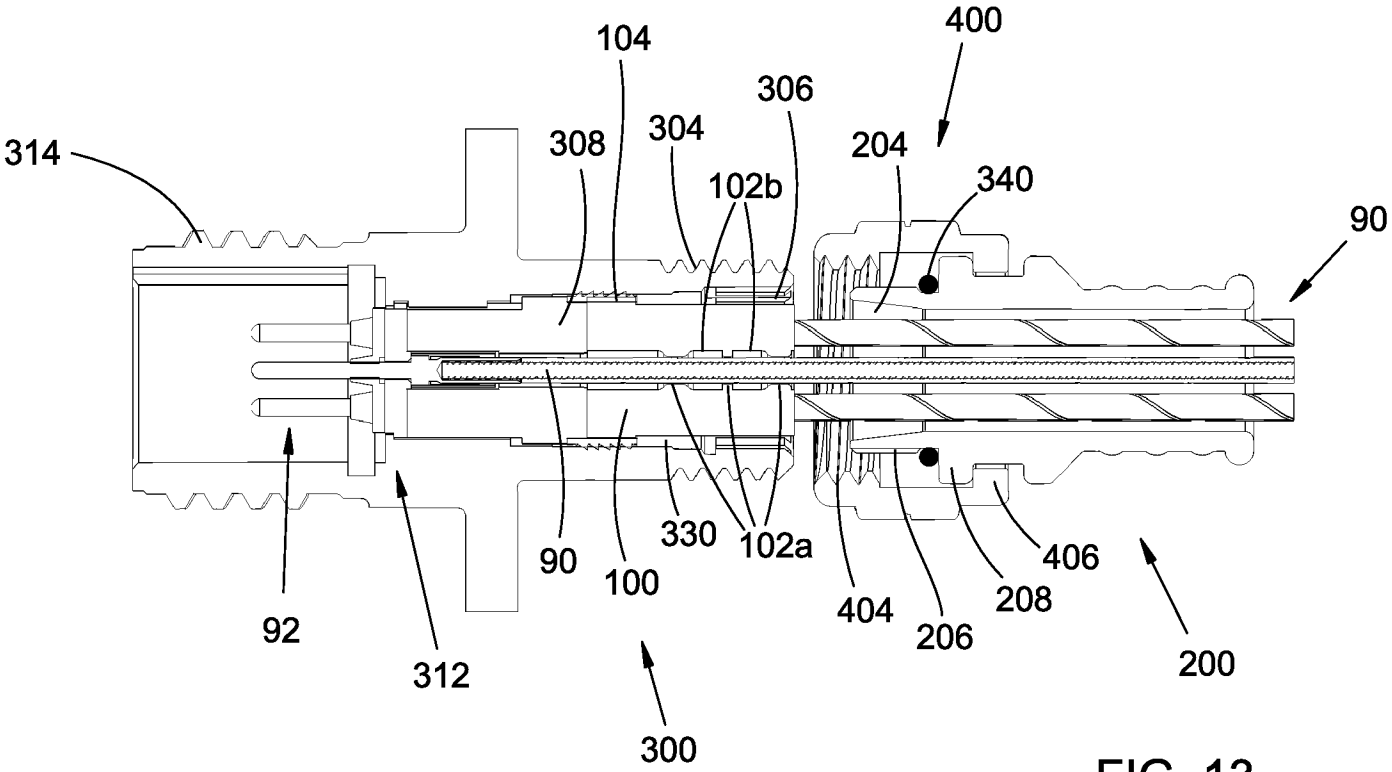
FIGS. 13 and 14 are side views of longitudinal cross sections of the example inventive connector assembly with wires and contacts and an O-ring in partly and fully assembled arrangements, respectively.
Figure 14:
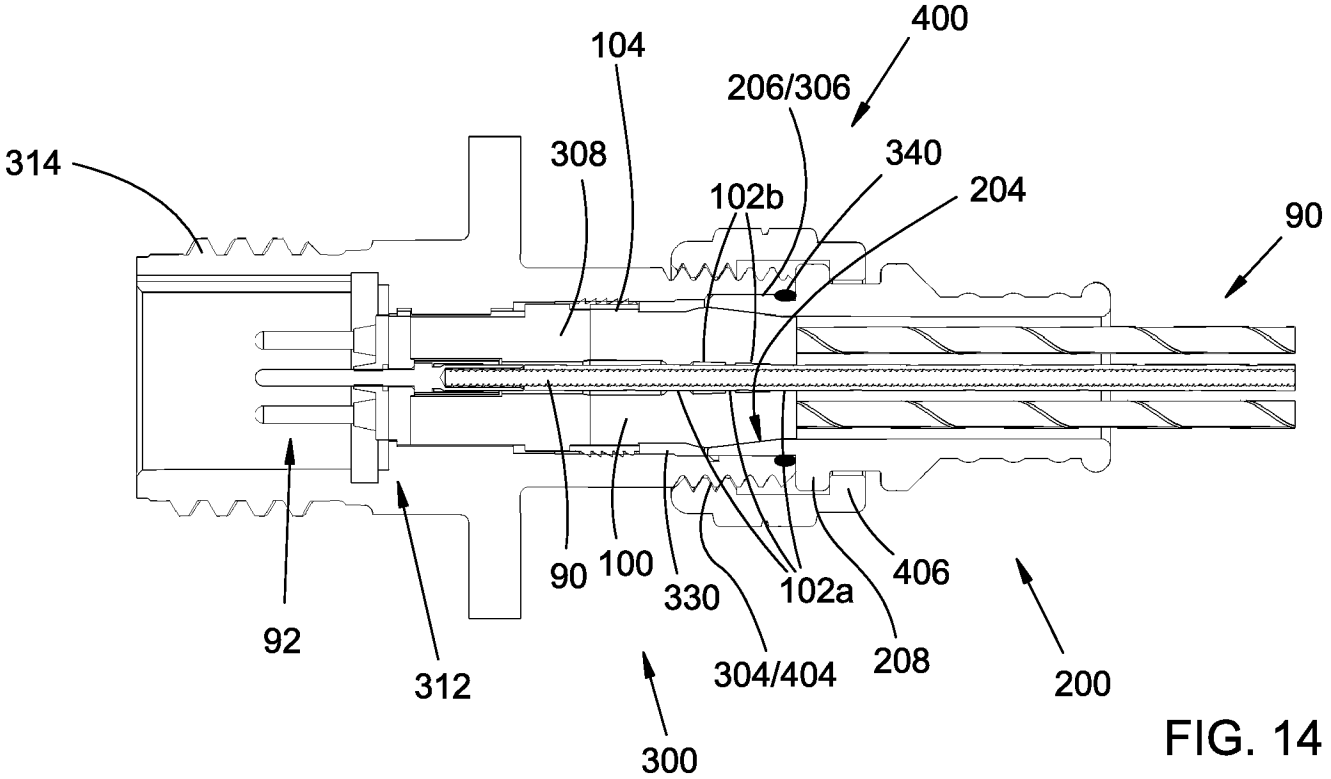

In some examples, the connector assembly further comprises a resilient O-ring 340 (as in FIGS. 12-14). At the forward limit of the forward movement of the rear connector assembly 200, engagement of the O-ring 340 between the outer surface of the forward portion of the rear connector body 200 (e.g., just forward of the flange 208) and the inner surface of the rear portion of the front axial passage 302 serves to establish a seal to substantially isolate from the use environment the rear portion of the front axial passage 302. The additional seal provided by the O-ring 304 is in addition to that provided by the grommet 100 and its radial compression by the tapered segment 204 of the rear axial passage 202. In examples that include splines 206/306, the splines typically are arranged or positioned so as not to interfere with sealing provided by the O-ring 340.

A method employing an inventive connector assembly, e.g., such as the examples shown in FIGS. 1-14, comprises: (a) inserting each one of a set of one or more wires 90 through the wire grommet 100 through a corresponding one of the one or more wire passages 102; (b) securing one or more corresponding electrical contacts 92, connected to the forward ends of the wires 90, to be held by the forward portion of the front connector body 300; (c) inserting the grommet 100 into the front axial passage 302; (d) engaging the front and rear connector bodies 300 and 200; (e) threadedly engaging the nut 400 and the front connector body 300; (f) tightening of the nut 400 threadedly engaged on the rearward portion of the front connector body 300, thereby resulting in forward movement of the nut 400 and the rear connector body 200 toward the front connector body 300, forward movement of the non-rotatably engaged forward portion of the rear connector body 200 into the rearward portion of the front axial passage 302, rearward movement of the rearward portion of the grommet 100 into the tapered segment 204 of the rear axial passage 202, and radial compression, by the tapered segment 204 of the rear axial passage 202, of the rearward portion of the grommet 100 and two or more of the wire-sealing segments 102*a* of each wire passage 102 therein. Typically, but not necessarily, the contacts 92 are connected to the wires 90 before the wires 90 are inserted through the wire grommet 100; typically, but not necessarily, the contacts 92 are connected to the wires 90 before the contacts 92 are secured to be held by the front connector body 300.

In some examples of such a method, the one or more wires 90 are inserted through the wire grommet 100 before inserting the wire grommet 100 into the front axial passage 302. In those instances, the wires 90 serve to align the wire passages 102 with corresponding wire passages in the front connector body 300. In other examples of such methods, the one or more wires 90 are inserted through the wire grommet 100 after inserting the wire grommet 100 into the front axial passage 302. In those instances, an insertion/removal tool is used that comprises a tube arranged (i) to receive therein one of the one or more wires 90, (ii) to be inserted along with the wire 90 through the corresponding one of the one or more wire passages 102, and (iii) to be withdrawn from the corresponding wire passage 102 leaving the wire 90 within the corresponding wire passage 102.

Figure 15:
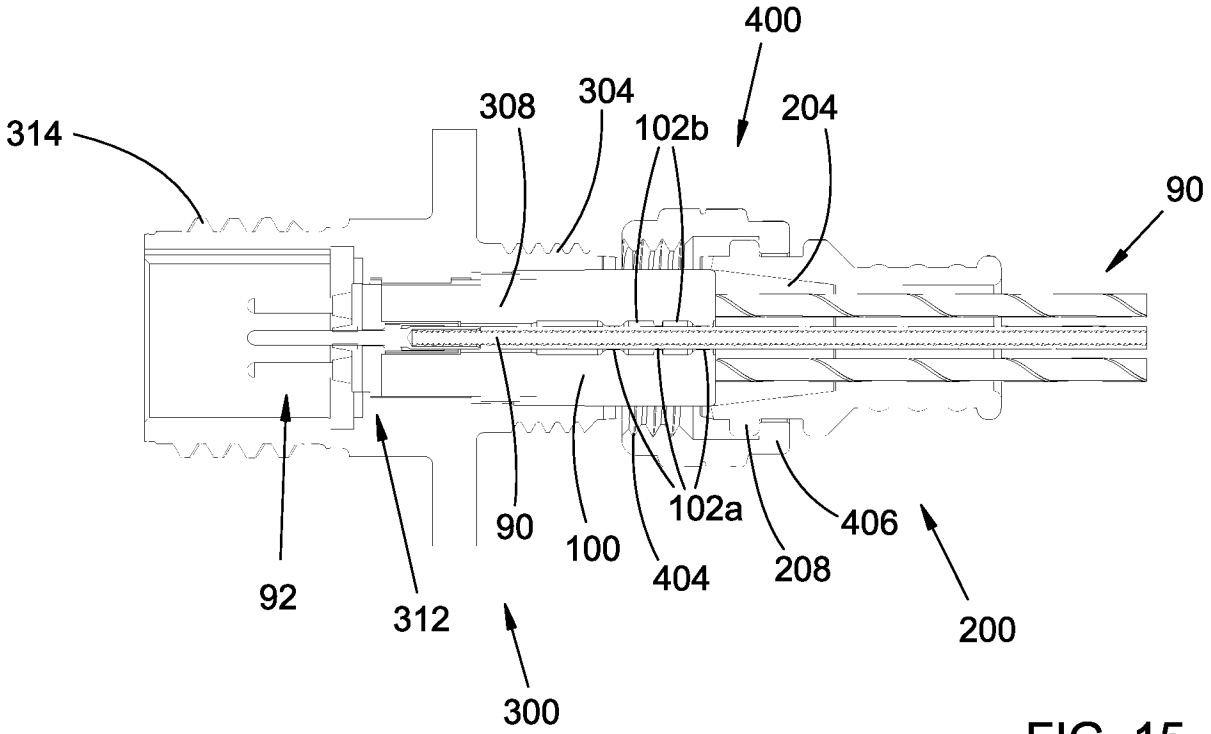
FIGS. 15 and 16 are side views of longitudinal cross sections of another example of an inventive connector assembly with wires and contacts and a rearward-protruding grommet in partly and fully assembled arrangements, respectively.
Figure 16:
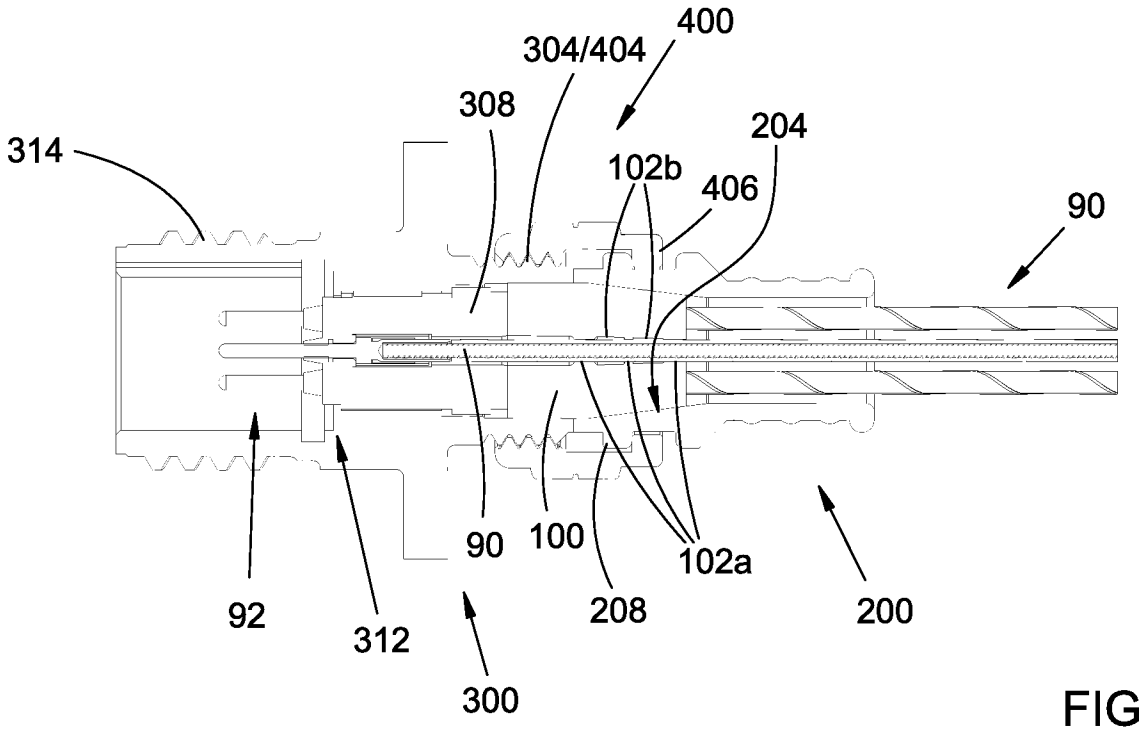

Another example embodiment is shown in FIGS. 15 and 16 wherein a rearward portion of the grommet 100, including at least two of the wire-sealing segments 102*a* of each wire passage 102, protrudes rearward from the front axial passage 302. The tapered segment 204 engages the outer surface of the protruding portion of the grommet 100 and, as the rear connector body 200 is driven forward by tightening the nut 400, compresses the grommet 100 radially, including two or more of the wire-sealing segments 102*a* of each wire passage 102 therein. The connector assembly can be structurally arranged so that the tapered segment 204 of the rear axial passage 202 does not enter the front axial passage 302 as the nut 400 is tightened and the nut 400 and the rear connector body 200 move forward. Alternatively, the connector assembly can be structurally arranged so that the forward movement of the nut 400 and the rear connector body 200 toward the front connector body 300 results in at least partial entry of a forward portion of the rear connector body 200 and the tapered segment 204 of the rear axial passage 202 into the front axial passage 302.

A method employing an inventive connector assembly, e.g., such as the examples shown in FIGS. 15 and 16, comprises: (a) inserting each one of a set of one or more wires 90 through the wire grommet 100 through a corresponding one of the one or more wire passages 102; (b) securing one or more corresponding electrical contacts 92, connected to the forward ends of the wires 90, to be held by the forward portion of the front connector body 300; (c) inserting the grommet 100 into the front axial passage 302, leaving a portion of the grommet 100 protruding from the front axial passage 302 rearward beyond a rear end of the front connector body 300; (d) threadedly engaging the nut 400 and the front connector body 300; and (e) tightening of the nut 400 threadedly engaged on the rearward portion of the front connector body 300, thereby resulting in forward movement of the nut 400 and the rear connector body 200 toward the front connector body 300, rearward movement of the protruding portion of the grommet 100 into the tapered segment 204 of the rear axial passage 202, and radial compression, by the tapered segment 204 of the rear axial passage 202, of at least the protruding portion of the grommet 100 and two or more of the wire-sealing segments 102*a* of each wire passage 102 therein. Typically, but not necessarily, the protruding portion of the grommet 100 is inserted into the tapered segment 204 of the rear axial passage 202, and the rear connector body advanced somewhat toward the front connector body 300, before the threads 304/404 are engaged. As described above, the wires 90 can be inserted through the grommet 100 before insertion of the grommet 100 into the front axial passage 302, or, using an insertion/removal tool, after insertion of the grommet 100 into the front axial passage 302.

In addition to the preceding, the following examples fall within the scope of the present disclosure or appended claims:

Example 1

A connector assembly comprising: (a) a resiliently deformable wire grommet having a substantially cylindrical outer surface and one or more axial wire passages therethrough, wherein each wire passage includes two or more wire-sealing segments and each wire-sealing segment is sized and shaped so as to (i) enable a corresponding wire to be inserted through the corresponding wire passage and (ii) form a seal around the corresponding inserted wire; (b) a substantially rigid rear connector body having a rear axial passage therethrough, wherein (i) a front end of the rear axial passage is large enough to receive therein a rearward portion of the grommet without substantial radial compression of the grommet and (ii) a rearward-tapered segment of the rear axial passage is structurally arranged so as to receive therein the rearward portion of the grommet, engage the outer surface of the rearward portion of the grommet, and compress radially the rearward portion of the grommet and two or more of the wire-sealing segments of each wire passage; (c) a substantially rigid front connector body having a front axial passage, wherein (i) a rearward portion of the front connector body includes external threads; (ii) a forward portion of the front connector body is structurally arranged so as to hold one or more electrical contacts that are each connected to a corresponding wire passing through the rear axial passage and the corresponding wire passage of the grommet, (iii) at least portions, including a rearward portion, of the front axial passage are structurally arranged so as to receive therein the grommet without substantial radial compression of the grommet, and (iv) the rearward portion of the front axial passage is structurally arranged to receive therein a forward portion of the rear connector body, including at least a portion of the tapered segment of the rear axial passage, interposed between the rearward portion of the grommet and an inner surface of the rearward portion of the front axial passage; (d) a nut with a central opening and internal threads, wherein the nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body, wherein: (e) an outer surface of the forward portion of the rear connector body and the inner surface of the rearward portion of the front axial passage are structurally adapted so as to effect non-rotatable and longitudinally movable engagement of the front and rear connector bodies; (f) the connector assembly is structurally arranged so that tightening of the nut threadedly engaged on the rearward portion of the front connector body results in forward movement of the nut and the rear connector body toward the front connector body, forward movement of the non-rotatably engaged forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and two or more of the wire-sealing segments of each wire passage therein.

Example 2

The connector assembly of Example 1 wherein the grommet extends rearward beyond a rear end of the front connector body.

Example 3

The connector assembly of Example 1 wherein a rear end of the front connector body extends rearward beyond a rear end of the grommet.

Example 4. The connector assembly of any one of Examples 1 through 3 wherein: (i) the outer surface of the forward portion of the rear connector body includes a set of one or more longitudinal splines or grooves, (ii) the inner surface of the rearward portion of the front axial passage includes a set of one or more longitudinal splines or grooves, and (iii) engagement of the splines or grooves of the front and rear connector bodies effects the non-rotatable and longitudinally movable engagement thereof.

Example 5

The connector assembly of any one of Examples 1 through 4 wherein: (i) the outer surface of the forward portion of the rear connector body includes a set of multiple radially outward-extending longitudinal splines, (ii) the inner surface of the rearward portion of the front axial passage includes a set of multiple radially inward-extending longitudinal splines, and (iii) engagement of the splines of the front and rear connector bodies effects the non-rotatable and longitudinally movable engagement thereof.

Example 6

The connector assembly of any one of Examples 1 through 5 wherein the connector assembly is structurally arranged so as to enable the non-rotatable and longitudinally movable engagement of the front and rear connector bodies without threaded engagement of the nut and the front connector body.

Example 7

A connector assembly comprising: (a) a resiliently deformable wire grommet having a substantially cylindrical outer surface and one or more axial wire passages therethrough, wherein each wire passage includes two or more wire-sealing segments and each wire-sealing segment is sized and shaped so as to (i) enable a corresponding wire to be inserted through the corresponding wire passage and (ii) form a seal around the corresponding inserted wire; (b) a substantially rigid rear connector body having a rear axial passage therethrough, wherein (i) a front end of the rear axial passage is large enough to receive therein a rearward portion of the grommet without substantial radial compression of the grommet and (ii) a rearward-tapered segment of the rear axial passage is structurally arranged so as to receive therein the rearward portion of the grommet, engage the outer surface of the rearward portion of the grommet, and compress radially the rearward portion of the grommet and two or more of the wire-sealing segments of each wire passage therein; (c) a substantially rigid front connector body having a front axial passage, wherein (i) a rearward portion of the front connector body includes external threads; (ii) a forward portion of the front connector body is structurally arranged so as to hold one or more electrical contacts that are each connected to a corresponding wire passing through the rear axial passage and the corresponding wire passage of the grommet, and (iii) a rearward portion of the front axial passage is structurally arranged so as to receive therein a forward portion of the grommet without substantial radial compression of the grommet, wherein a portion of the grommet protrudes from the front axial passage rearward beyond a rear end of the front connector body; and (d) a nut with a central opening and internal threads, wherein the nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body, (e) wherein the connector assembly is structurally arranged so that tightening of the nut threadedly engaged on the rearward portion of the front connector body results in forward movement of the nut and the rear connector body toward the front connector body, rearward movement of the protruding portion of the grommet into the tapered segment of the rear axial passage, and radial compression, by the tapered segment of the rear axial passage, of at least the protruding portion of the grommet and two or more of the wire-sealing segments of each wire passage therein.

Example 8

The connector assembly of Example 7 wherein the connector assembly is structurally arranged so that the forward movement of the nut and the rear connector body toward the front connector body results in at least partial entry of a forward portion of the rear connector body and the tapered segment of the rear axial passage into the front axial passage.

Example 9

The connector assembly of Example 7 wherein the connector assembly is structurally arranged so as to substantially prevent entry of any portion of the rear connector body into the front axial passage.

Example 10

The connector assembly of any one of Examples 1 through 9 wherein each wire passage includes an intervening, transversely enlarged, internal chamber between each adjacent pair of wire-sealing segments along each wire passage.

Example 11

The connector assembly of any one of Examples 1 through 10 wherein (i) the tapered segment of the rear axial passage is structurally arranged so as to compress radially the rearward portion of the grommet and three or more of the wire-sealing segments of each wire passage and (ii) the connector assembly is structurally arranged so that tightening of the nut results in radial compression of three or more of the wire-sealing segments of each wire passage.

Example 12

The connector assembly of any one of Examples 1 through 11 wherein the grommet or the front axial passage includes a rotational indexing structure arranged to permit insertion of the grommet into the front axial passage in only one relative orientation about a longitudinal axis.

Example 13

The connector assembly of any one of Examples 1 through 12 wherein: (i) the outer surface of the grommet includes a set of one or more longitudinal grooves or splines, (ii) the inner surface of the front axial passage includes a set of one or more longitudinal grooves or splines, and (iii) engagement of the grooves or splines of the grommet and the front axial passage are structurally arranged to permit insertion of the grommet into the front axial passage in only one relative orientation about a longitudinal axis.

Example 14

The connector assembly of any one of Examples 1 through 13 wherein a forward portion of the tapered segment of the rear axial passage is structurally arranged so as to accommodate radial expansion of a portion of the grommet forward of the radially compressed rearward portion of the grommet.

Example 15

The connector assembly of any one of Examples 1 through 14 wherein the front and rear connector bodies are structurally arranged so that, at a forward limit of the forward movement, a gap remains at a front end of the rear connector body that can accommodate radial expansion of a portion of the grommet forward of the radially compressed rearward portion of the grommet.

Example 16

The connector assembly of Example 15 wherein a resilient sealant at least partly fills the gap.

Example 17

The connector assembly of any one of Examples 1 through 16 wherein (i) the rear connector body includes a radially outward-extending circumferential flange and (ii) contact between the flange and a rear end of the front connector body limits the forward movement.

Example 18

The connector assembly of any one of Examples 1 through 17 further comprising a resilient O-ring, wherein, at a forward limit of the forward movement, engagement of the O-ring between the outer surface of the forward portion of the rear connector body and the inner surface of the rear portion of the front axial passage serves to substantially isolate from a use environment the rear portion of the front axial passage.

Example 19

A method employing the connector assembly of any one of Examples 1 through 6 or 10 through 18, the method comprising: (a) inserting each one of a set of one or more wires through the wire grommet through a corresponding one of the one or more wire passages; (b) securing one or more corresponding electrical contacts, connected to the forward ends of the one or more wires, to be held by the forward portion of the front connector body; (c) inserting the grommet into the front axial passage; (d) engaging the front and rear connector bodies; (e) threadedly engaging the nut and the front connector body; and (f) tightening of the nut threadedly engaged on the rearward portion of the front connector body, thereby resulting in forward movement of the nut and the rear connector body toward the front connector body, forward movement of the non-rotatably engaged forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and two or more of the wire-sealing segments of each wire passage therein.

Example 20

A method employing the connector assembly of any one of Examples 7 through 9, the method comprising: (a) inserting each one of a set of one or more wires through the wire grommet through a corresponding one of the one or more wire passages; (b) securing one or more corresponding electrical contacts, connected to the forward ends of the wires 90, to be held by forward portion of the connector body; (c) inserting the grommet partly into the front axial passage, leaving a portion of the grommet protruding from the front axial passage rearward beyond a rear end of the front connector body; (d) threadedly engaging the nut and the front connector body; and (e) tightening of the nut threadedly engaged on the rearward portion of the front connector body, thereby resulting in forward movement of the nut and the rear connector body toward the front connector body, rearward movement of the protruding portion of the grommet into the tapered segment of the rear axial passage, and radial compression, by the tapered segment of the rear axial passage, of at least the protruding portion of the grommet and two or more of the wire-sealing segments of each wire passage therein.

Example 21

The method of any one of Examples 19 or 20 wherein the one or more corresponding electrical contacts are connected to the one or more wires before the one or more wires are inserted through the wire grommet.

Example 22

The method of any one of Examples 19 through 21 wherein the one or more wires are inserted through the wire grommet before inserting the wire grommet into the front axial passage.

Example 23

The method of any one of Examples 19 through 21 wherein the one or more wires are inserted through the wire grommet after inserting the wire grommet into the front axial passage, using an insertion/removal tool that comprises a tube arranged (i) to receive therein one of the one or more wires, (ii) to be inserted along with the wire through the corresponding one of the one or more wire passages, and (iii) to be withdrawn from the corresponding wire passage leaving the wire within the corresponding wire passage.

Example 24

The method of any one of Examples 19 through 23 wherein each one of the one or more wires has a non-circular transverse cross section.

Example 25

The method of any one of Examples 19 through 24 wherein each one of the one or more wires has an oval or elliptical cross section.

Example 26

The method of any one of Examples 19 through 25 wherein each one of the one or more wires includes spiral-wrapped insulation.

Example 27

The method of any one of Examples 19 through 26 further comprising inserting into a sheath surrounding the set of one or more wires the rearward portion of the rear connector body.

Example 28

The method of Example 27 wherein the sheath includes electrically conductive sheathing arranged to serve as electromagnetic shielding for the set of one or more wires, the rear connector body comprises an electrically conductive material, and the electrically conductive sheathing is in electrical contact with the rear connector body.

Example 29

The method of any one of Examples 27 or 28 wherein the sheath includes electrically insulating sheathing.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the preceding numbered examples and the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure (including the numbered examples) or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise.

In the appended claims, if the provisions of 35 USC §112 (f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A connector assembly comprising:

(a) a resiliently deformable wire grommet having a substantially cylindrical outer surface and one or more axial wire passages therethrough, wherein each wire passage includes two or more wire-sealing segments and each wire-sealing segment is sized and shaped so as to (i) enable a corresponding wire to be inserted through the corresponding wire passage and (ii) form a seal around the corresponding inserted wire;

(b) a substantially rigid rear connector body having a rear axial passage therethrough, wherein (i) a front end of the rear axial passage is large enough to receive therein a rearward portion of the grommet without substantial radial compression of the grommet and (ii) a rearward-tapered segment of the rear axial passage is structurally arranged so as to receive therein the rearward portion of the grommet, engage the outer surface of the rearward portion of the grommet, and compress radially the rearward portion of the grommet and two or more of the wire-sealing segments of each wire passage;

(c) a substantially rigid front connector body having a front axial passage, wherein (i) a rearward portion of the front connector body includes external threads; (ii) a forward portion of the front connector body is structurally arranged so as to hold one or more electrical contacts that are each connected to a corresponding wire passing through the rear axial passage and the corresponding wire passage of the grommet, (iii) at least portions, including a rearward portion, of the front axial passage are structurally arranged so as to receive therein the grommet without substantial radial compression of the grommet, and (iv) the rearward portion of the front axial passage is structurally arranged to receive therein a forward portion of the rear connector body, including at least a portion of the tapered segment of the rear axial passage, interposed between the rearward portion of the grommet and an inner surface of the rearward portion of the front axial passage;

(d) a nut with a central opening and internal threads, wherein the nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body, wherein:

(e) an outer surface of the forward portion of the rear connector body and the inner surface of the rearward portion of the front axial passage are structurally adapted so as to effect non-rotatable and longitudinally movable engagement of the front and rear connector bodies;

(f) the connector assembly is structurally arranged so that tightening of the nut threadedly engaged on the rearward portion of the front connector body results in forward movement of the nut and the rear connector body toward the front connector body, forward movement of the non-rotatably engaged forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and two or more of the wire-sealing segments of each wire passage therein.

2. The connector assembly of claim 1 wherein each wire passage includes an intervening, transversely enlarged, internal chamber between each adjacent pair of wire-sealing segments along each wire passage.

3. The connector assembly of claim 1 wherein (i) the tapered segment of the rear axial passage is structurally arranged so as to compress radially the rearward portion of the grommet and three or more of the wire-sealing segments of each wire passage and (ii) the connector assembly is structurally arranged so that tightening of the nut results in radial compression of three or more of the wire-sealing segments of each wire passage.

4. The connector assembly of claim 1 wherein the grommet extends rearward beyond a rear end of the front connector body.

5. The connector assembly of claim 1 wherein a rear end of the front connector body extends rearward beyond a rear end of the grommet.

6. The connector assembly of claim 1 wherein: (i) the outer surface of the forward portion of the rear connector body includes a set of one or more longitudinal splines or grooves, (ii) the inner surface of the rearward portion of the front axial passage includes a set of one or more longitudinal splines or grooves, and (iii) engagement of the splines or grooves of the front and rear connector bodies effects the non-rotatable and longitudinally movable engagement thereof.

7. The connector assembly of claim 1 wherein: (i) the outer surface of the forward portion of the rear connector body includes a set of multiple radially outward-extending longitudinal splines, (ii) the inner surface of the rearward portion of the front axial passage includes a set of multiple radially inward-extending longitudinal splines, and (iii) engagement of the splines of the front and rear connector bodies effects the non-rotatable and longitudinally movable engagement thereof.

8. The connector assembly of claim 1 wherein the connector assembly is structurally arranged so as to enable the non-rotatable and longitudinally movable engagement of the front and rear connector bodies without threaded engagement of the nut and the front connector body.

9. The connector assembly of claim 1 wherein the grommet or the front axial passage includes a rotational indexing structure arranged to permit insertion of the grommet into the front axial passage in only one relative orientation about a longitudinal axis.

10. The connector assembly of claim 1 wherein a forward portion of the tapered segment of the rear axial passage is structurally arranged so as to accommodate radial expansion of a portion of the grommet forward of the radially compressed rearward portion of the grommet.

11. The connector assembly of claim 1 wherein the front and rear connector bodies are structurally arranged so that, at a forward limit of the forward movement, a gap remains at a front end of the rear connector body that can accommodate radial expansion of a portion of the grommet forward of the radially compressed rearward portion of the grommet.

12. The connector assembly of claim 1 wherein (i) the rear connector body includes a radially outward-extending circumferential flange and (ii) contact between the flange and a rear end of the front connector body limits the forward movement.

13. The connector assembly of claim 1 further comprising a resilient O-ring, wherein, at a forward limit of the forward movement, engagement of the O-ring between the outer surface of the forward portion of the rear connector body and the inner surface of the rear portion of the front axial passage serves to substantially isolate from a use environment the rear portion of the front axial passage.

14. A method employing the connector assembly of claim 1, the method comprising:

(a) inserting each one of a set of one or more wires through the wire grommet through a corresponding one of the one or more wire passages;

(b) securing one or more corresponding electrical contacts, connected to the forward ends of the one or more wires, to be held by the forward portion of the front connector body;

(c) inserting the grommet into the front axial passage;

(d) engaging the front and rear connector bodies;

(e) threadedly engaging the nut and the front connector body; and (f) tightening of the nut threadedly engaged on the rearward portion of the front connector body, thereby resulting in forward movement of the nut and the rear connector body toward the front connector body, forward movement of the non-rotatably engaged forward portion of the rear connector body into the rearward portion of the front axial passage, rearward movement of the rearward portion of the grommet into the tapered segment of the rear axial passage, and radial compression, by the tapered segment of the rear axial passage, of the rearward portion of the grommet and two or more of the wire-sealing segments of each wire passage therein.

15. The method of claim 14 wherein the one or more wires are inserted through the wire grommet before inserting the wire grommet into the front axial passage.

16. The method of claim 14 wherein the one or more wires are inserted through the wire grommet after inserting the wire grommet into the front axial passage, using an insertion/removal tool that comprises a tube arranged (i) to receive therein one of the one or more wires, (ii) to be inserted along with the wire through the corresponding one of the one or more wire passages, and (iii) to be withdrawn from the corresponding wire passage leaving the wire within the corresponding wire passage.

17. The method of claim 14 wherein each one of the one or more wires has a non-circular transverse cross section.

18. The method of claim 14 wherein each one of the one or more wires has an oval or elliptical cross section.

19. The method of claim 14 wherein each one of the one or more wires includes spiral-wrapped insulation.

20. A connector assembly comprising:

(a) a resiliently deformable wire grommet having a substantially cylindrical outer surface and one or more axial wire passages therethrough, wherein each wire passage includes two or more wire-sealing segments and each wire-sealing segment is sized and shaped so as to (i) enable a corresponding wire to be inserted through the corresponding wire passage and (ii) form a seal around the corresponding inserted wire;

(b) a substantially rigid rear connector body having a rear axial passage therethrough, wherein (i) a front end of the rear axial passage is large enough to receive therein a rearward portion of the grommet without substantial radial compression of the grommet and (ii) a rearward-tapered segment of the rear axial passage is structurally arranged so as to receive therein the rearward portion of the grommet, engage the outer surface of the rearward portion of the grommet, and compress radially the rearward portion of the grommet and two or more of the wire-sealing segments of each wire passage therein;

(c) a substantially rigid front connector body having a front axial passage, wherein (i) a rearward portion of the front connector body includes external threads; (ii) a forward portion of the front connector body is structurally arranged so as to hold one or more electrical contacts that are each connected to a corresponding wire passing through the rear axial passage and the corresponding wire passage of the grommet, and (iii) a rearward portion of the front axial passage is structurally arranged so as to receive therein a forward portion of the grommet without substantial radial compression of the grommet, wherein a portion of the grommet protrudes from the front axial passage rearward beyond a rear end of the front connector body; and (d) a nut with a central opening and internal threads, wherein the nut is structurally arranged so as to (i) receive through the central opening a rearward portion of the rear connector body, (ii) obstruct rearward movement of the forward portion of the rear connector body through the central opening, and (iii) engage with the internal threads the external threads of the front connector body, (e) wherein the connector assembly is structurally arranged so that tightening of the nut threadedly engaged on the rearward portion of the front connector body results in forward movement of the nut and the rear connector body toward the front connector body, rearward movement of the protruding portion of the grommet into the tapered segment of the rear axial passage, and radial compression, by the tapered segment of the rear axial passage, of at least the protruding portion of the grommet and two or more of the wire-sealing segments of each wire passage therein.

21. The connector assembly of claim 20 wherein the connector assembly is structurally arranged so that the forward movement of the nut and the rear connector body toward the front connector body results in at least partial entry of a forward portion of the rear connector body and the tapered segment of the rear axial passage into the front axial passage.

22. The connector assembly of claim 20 wherein the connector assembly is structurally arranged so as to substantially prevent entry of any portion of the rear connector body into the front axial passage.

23. A method employing the connector assembly of claim 20, the method comprising:

(a) inserting each one of a set of one or more wires through the wire grommet through a corresponding one of the one or more wire passages;

(b) securing one or more corresponding electrical contacts, connected to the forward ends of the wires 90, to be held by a forward portion of the connector body;

(c) inserting the grommet partly into the front axial passage, leaving a portion of the grommet protruding from the front axial passage rearward beyond a rear end of the front connector body;

(d) threadedly engaging the nut and the front connector body; and (e) tightening of the nut threadedly engaged on the rearward portion of the front connector body, thereby resulting in forward movement of the nut and the rear connector body toward the front connector body, rearward movement of the protruding portion of the grommet into the tapered segment of the rear axial passage, and radial compression, by the tapered segment of the rear axial passage, of at least the protruding portion of the grommet and two or more of the wire-sealing segments of each wire passage therein.

24. The method of claim 23 wherein the one or more wires are inserted through the wire grommet before inserting the wire grommet into the front axial passage.

25. The method of claim 23 wherein the one or more wires are inserted through the wire grommet after inserting the wire grommet into the front axial passage, using an insertion/removal tool that comprises a tube arranged (i) to receive therein one of the one or more wires, (ii) to be inserted along with the corresponding wire through the corresponding one of the one or more wire passages, and (iii) to be withdrawn from the corresponding wire passage leaving the wire within the corresponding wire passage.

26. The method of claim 23 wherein each one of the one or more wires has an oval, elliptical, or non-circular cross section.

27. The method of claim 23 wherein each one of the one or more wires includes spiral-wrapped insulation.

* * * * *